US006422227B1

(12) United States Patent
Kobayashi et al.

(10) Patent No.: US 6,422,227 B1
(45) Date of Patent: Jul. 23, 2002

(54) DICING APPARATUS, KERF INSPECTING METHOD AND KERF INSPECTING SYSTEM

(75) Inventors: Ryoko Kobayashi; Hiroyuki Yasutomi, both of Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 0 days.

(21) Appl. No.: 09/704,734

(22) Filed: Nov. 3, 2000

(30) Foreign Application Priority Data

Nov. 8, 1999 (JP) ..... 11-316605

(51) Int. Cl.[7] ..... B28D 1/04
(52) U.S. Cl. ..... 125/13.01; 125/14
(58) Field of Search ..... 125/13.01, 14, 125/20; 451/1, 2, 8; 83/73, 425

(56) References Cited

U.S. PATENT DOCUMENTS 5,842,461 A * 12/1998 Azuma ..... 125/13.01
6,192,289 B1 * 2/2000 Geffen et al. ..... 700/121
6,102,023 A * 8/2000 Ishiwata et al. ..... 125/13.01
6,142,138 A * 11/2000 Azuma et al. ..... 125/14
6,216,682 B1 * 4/2001 Nambu et al. ..... 125/13.01

* cited by examiner

*Primary Examiner*—Timothy V. Eley
*Assistant Examiner*—Dung Van Nguyen
(74) *Attorney, Agent, or Firm*—Nixon Peabody LLP; David S. Safran

(57) ABSTRACT

In a dicing apparatus that comprises a first blade and a second blade, the first blade cuts a wafer along a street along which the first blade has not previously cut the wafer, and the second blade cuts the wafer along a street along which the first blade has not cut the wafer, and then kerfs made by the blades are inspected. In this method, the kerfs are made along the different streets, and thus the kerfs made by the blades can be accurately inspected.

9 Claims, 8 Drawing Sheets

BLADES OF DIFFERENT KINDS

BLADES OF SAME KIND

PRIOR ART

DICING APPARATUS, KERF INSPECTING METHOD AND KERF INSPECTING SYSTEM

BACKGROUND OF THE INVENTION

1. Field of the Invention

The present invention relates generally to a dicing apparatus, a kerf inspecting method and a kerf inspecting system, and more particularly to a dicing apparatus that has two spindles to which blades are attached, a kerf inspecting method and a kerf inspecting system.

2. Description of Related Art

A dicing apparatus cuts a wafer with an outer diameter blade with abrasive grains into the dice. The blade becomes worn, and thus chipping occurs and the center of the blade is displaced from the center of a street (a border line between chips on the wafer) along which the wafer is cut due to heat deformation of the blade. Therefore, the dicing apparatus inspects a groove (a kerf) made by the blade at a predetermined time. The dicing apparatus determines a position and a width of the kerf and whether chipping has occurred by imaging the kerf with a camera and processes the image, or an operator determines them manually by sight.

The dicing apparatus has one spindle to which the blade is attached or two spindles. A twin-spindle dicing saw with two spindles cuts the wafer along two streets at one time or in the step-cut method. In the step-cut method, a first blade cuts the wafer along a street to make a groove with a predetermined depth, and then a second blade cuts the wafer along the groove to cut off the wafer along the street.

Conventionally, the twin-spindle dicing saw inspects kerfs made by the blades as follows. First, the first blade cuts the wafer along a street to make a kerf with the predetermined depth, and the dicing saw inspects the kerf made by the first blade. Then, the second blade cuts the wafer along the kerf made by the first blade to make a kerf, and the dicing saw inspects the kerf made by the second blade.

As described above, the dicing saw cuts the wafer to make the kerfs in the same way as in the cutting operation and inspects the kerfs.

In the conventional kerf inspecting method, however, the groove g made by the second blade is along the same street as the groove G made by the first blade as shown in FIG. 8(*a*), and thus it is difficult to inspect the kerfs by processing the images. In particular, if the blades are of the same thickness as shown in FIG. 8(*b*), the groove $G_1$ made by the first blade can not be distinguished from the groove $G_2$ made by the second blade, and thus the kerfs can not be accurately inspected.

SUMMARY OF THE INVENTION

In view of the foregoing, it is an object of the present invention to provide a dicing apparatus that can accurately inspect kerfs, a kerf inspecting method and a kerf inspecting system.

To achieve the above-mentioned object, the present invention is directed to a dicing apparatus, comprising: a first blade which cuts a wafer along a street on the wafer to make a groove with a predetermined depth; and a second blade which cuts the wafer along the groove to cut off the wafer along the street, wherein the dicing apparatus sets a time and a position at which each blade makes a kerf for inspecting the kerf.

According to the present invention, the dicing apparatus sets the time and the position at which each blade makes the kerf for inspecting the kerf. Thus, each blade can make the kerf at the most suitable time at the most suitable position.

To achieve the above-mentioned object, the present invention is directed to a kerf inspecting method for a dicing apparatus that comprises a first blade cutting a wafer along a street on the wafer to make a groove with a first predetermined depth and a second blade cutting the wafer along the groove to cut off the wafer along the street, the kerf inspecting method comprising the steps of: cutting, in a state where the wafer has not been cut along a street, the wafer along the street with the second blade to make a kerf with a second predetermined depth; and inspecting the kerf made by the second blade;

According to the present invention, the second blade cuts the wafer along the street along which the first blade has not cut the wafer to make the kerf with the predetermined depth, and then the dicing apparatus inspects the kerf made by the second blade. Therefore, since the kerf is made along the street along which the first blade has not cut the wafer, the kerf made by the second blade is accurately inspected.

Preferably, the second predetermined depth of the kerf made by the second blade is smaller than the first predetermined depth of the groove made by the first blade; and after the kerf is inspected, the first blade cuts the wafer along the kerf made by the second blade to make the groove with the first predetermined depth, and the second blade then cuts the wafer along the groove to cut off the wafer along the street. Thereby, the kerf made by the second blade can be erased by the first blade, and the cutting operation can be resumed without any trouble after the kerf is inspected.

To achieve the above-mentioned object, the present invention is directed to a kerf inspecting method for a dicing apparatus that comprises a first blade cutting a wafer along a street on the wafer to make a groove with a first predetermined depth and a second blade cutting the wafer along the groove to cut off the wafer along the street, the kerf inspecting method comprising the steps of: cutting, in a state where the wafer has not been cut along a first street, the wafer along the first street with the first blade to make a first kerf with a second predetermined depth; cutting, in a state where the wafer has not been cut along a second street, the wafer along the second street with the second blade to make a second kerf with a third predetermined depth; and inspecting the first and second kerfs made by the first blade and the second blade.

According to the present invention, the kerfs are made by the blades along different streets to be inspected. Therefore, the kerfs made by the blades can be accurately inspected.

Preferably, the third predetermined depth of the second kerf made by the second blade is smaller than the first predetermined depth of the groove made by the first blade; and after the second kerf is inspected, the first blade cuts the wafer along the second kerf made by the second blade to make the groove with the first predetermined depth, and the second blade then cuts the wafer along the groove to cut off the wafer along the second street. Thereby, the kerf made by the second blade can be erased by the first blade, and the cutting operation can be resumed without any trouble after the kerf is inspected.

Preferably, the second predetermined depth of the first kerf made by the first blade is equal to the first predetermined depth of the groove made by the first blade. However, the second predetermined depth of the first kerf made by the first blade can be different from the first predetermined depth of the groove made by the first blade.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
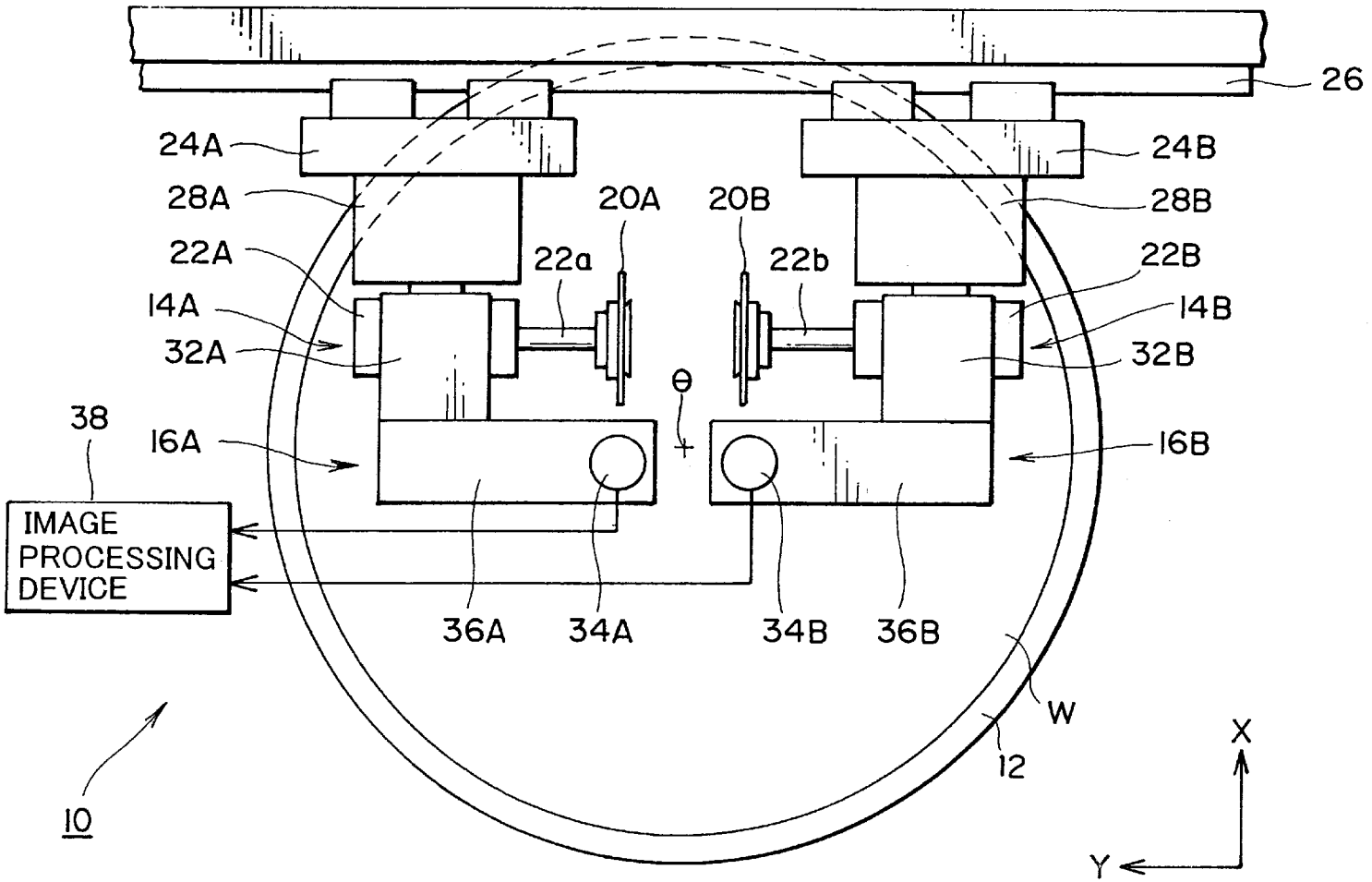
FIG. 1 is a plan view showing a structure of a twin-spindle dicing saw.

FIG. 1 is a plan view showing a structure of a twin-spindle dicing saw 10 to which the present invention is applied.

As shown in FIG. 1, the twin-spindle dicing saw 10 comprises a wafer table 12 that holds a wafer W, a pair of cutting units 14A and 14B that cuts the wafer W held on the wafer table 12, a pair of imaging units 16A and 16B that images the wafer W, and a controlling device (not shown).

The wafer table 12 is shaped like a disc, and it holds the bottom of the wafer W by suction. The wafer table 12 is moved along the X-axis in FIG. 1 by a moving mechanism (not shown). The wafer table 12 is also rotated about its axis (θ-axis) by a rotating mechanism (not shown).

The wafer W is held on the wafer table 12 while being mounted on a wafer frame (not shown). The wafer W is held on the wafer table 12 while being put on a wafer sheet stuck on the wafer frame.

The cutting units 14A and 14B have blades 20A and 20B, respectively, that cut the wafer W, and the blades 20A and 20B are connected to spindles 22*a* and 22*b* of spindle motors 22A and 22B, respectively. The cutting units 14A and 14B are separately moved along the Y-axis in FIG. 1 and the Z-axis by a spindle moving mechanism.

Figure 2:
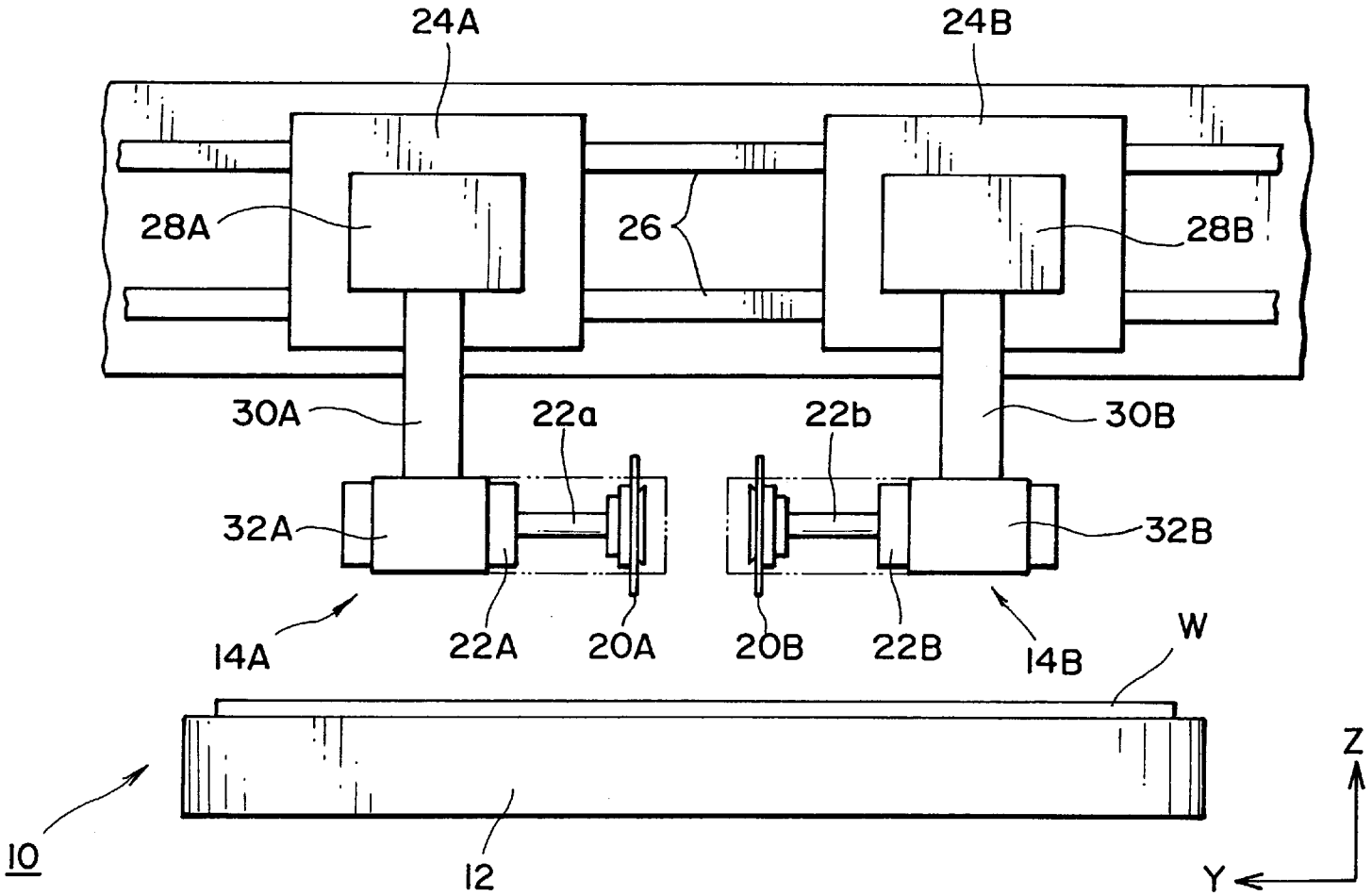
FIG. 2 is a front view showing the structure of the twin-spindle dicing saw.

As shown in FIG. 2, the spindle moving mechanism has Y a pair of carriages 24A and 24B. The Y carriages 24A and 24B are slidably provided on guide rails 26 provided along the Y-axis. The Y carriages 24A and 24B are separately slid along the Y-axis by sliding devices (not shown) such as liner motors.

The Y carriages 24A and 24B have Z moving mechanisms 28A and 28B, respectively, composed of linear guides and driving devices (not shown). The Z moving mechanisms 28A and 28B moves Z carriages 30A and 30B along the Z-axis in FIG. 2. Motor brackets 32A and 32B are attached to the ends of the Z carriages 30A and 30B, and the spindle motors 22A and 22B are attached to the motor brackets 32A and 32B.

The above-described spindle moving mechanism moves the cutting units 14A and 14B along the Y-axis and the Z-axis. The sliding of the Y carriages 24A and 24B along the guide rails 26 moves the cutting units 14A and 14B along the Y-axis, and the moving of the Z carriages 30A and 30B of the Z moving mechanisms 28A and 28B moves the cutting units 14A and 14B along the Z-axis (upward and downward). The moving of the cutting units 14A and 14B along the Y-axis changes cutting pitches, and the moving of the cutting units 14A and 14B along the Z-axis changes depths of cut.

As shown in FIG. 1, the imaging units 16A and 16B have ITV cameras 34A and 34B, respectively. The ITV cameras 34A and 34B are held by camera holders 36A and 36B, which are fixed to the motor brackets 32A and 32B. The ITV cameras 34A and 34B image the top of the wafer W held on the wafer table 12, and outputs the image data to an image processing device 38. The image processing device 38 inspects grooves (kerfs) made by the blades 20A and 20B by processing the image data. In the kerf inspection, the image processing device 38 determines kerf positions, kerf widths and whether or not chipping has occurred.

The controlling device controls the wafer table 12 and the cutting units 14A and 14B in accordance with a predetermined cutting pattern to cut the wafer W held on the wafer table 12 along streets on the wafer W. The controlling device inspects the kerfs at a predetermined time or in accordance with an instruction of an operator.

The wafer cutting method for the above-described twin-spindle dicing saw 10 will now be explained.

The twin-spindle dicing saw 10 cuts the wafer W in the step-cut method. First, the first blade 20A cuts the wafer W along the streets with a predetermined depth, and then the second blade 20B cuts the wafer W along the grooves made by the first blade 20A to cut off the wafer W along the streets.

The first blade 20A that cuts the wafer W first is thicker than the second blade 20B.

The detail of the cutting method is as follows.

First, the controlling device drives the spindle motors 22A and 22B to rotate the first blade 20A and the second blade 20B. Then, the controlling device drives the sliding devices of the spindle moving mechanism to move the first blade 20A and the second blade 20B so that the interval between the blades 20A and 20B is a predetermined interval. In this embodiment, the predetermined interval is the same as three pitches between the streets.

Then, the controlling device drives the Z moving mechanisms 28A and 28B to lower the blades 20A and 20B predetermined distances. This sets the depths of cut for the blades 20A and 20B to predetermined depths of cut.

The predetermined depth of cut for the second blade 20B is larger than that for the first blade 20A so that the second blade 20B cuts off the wafer W along the streets by cutting the wafer W along the grooves G made by the first blade 20A.

After setting the depths of cut, the controlling device drives the spindle motors 22A and 22B to rotate the first blade 20A and the second blade 20B. Then, the controlling device drives the moving mechanism to move the wafer table 12 along the X-axis. This cuts the wafer W along a street $S_{X1}$ with the predetermined depth to make a groove $G_{X1}$ with the predetermined depth along the street $S_{X1}$ (see FIG. 3(*a*)).

Next, the controlling device drives the sliding devices of the spindle moving mechanism to move the first blade 20A and the second blade 20B one pitch along the Y-axis. Then, the controlling device moves the wafer table 12 along the X-axis again so that the first blade 20A cuts the wafer W along the next street $S_{X2}$.

The above-described cutting operation is repeated again and again so that the first blade 20A sequentially cuts the wafer W along the streets $S_{X1}$, $S_{X2}$, . . . along the X-axis.

Figure 3:
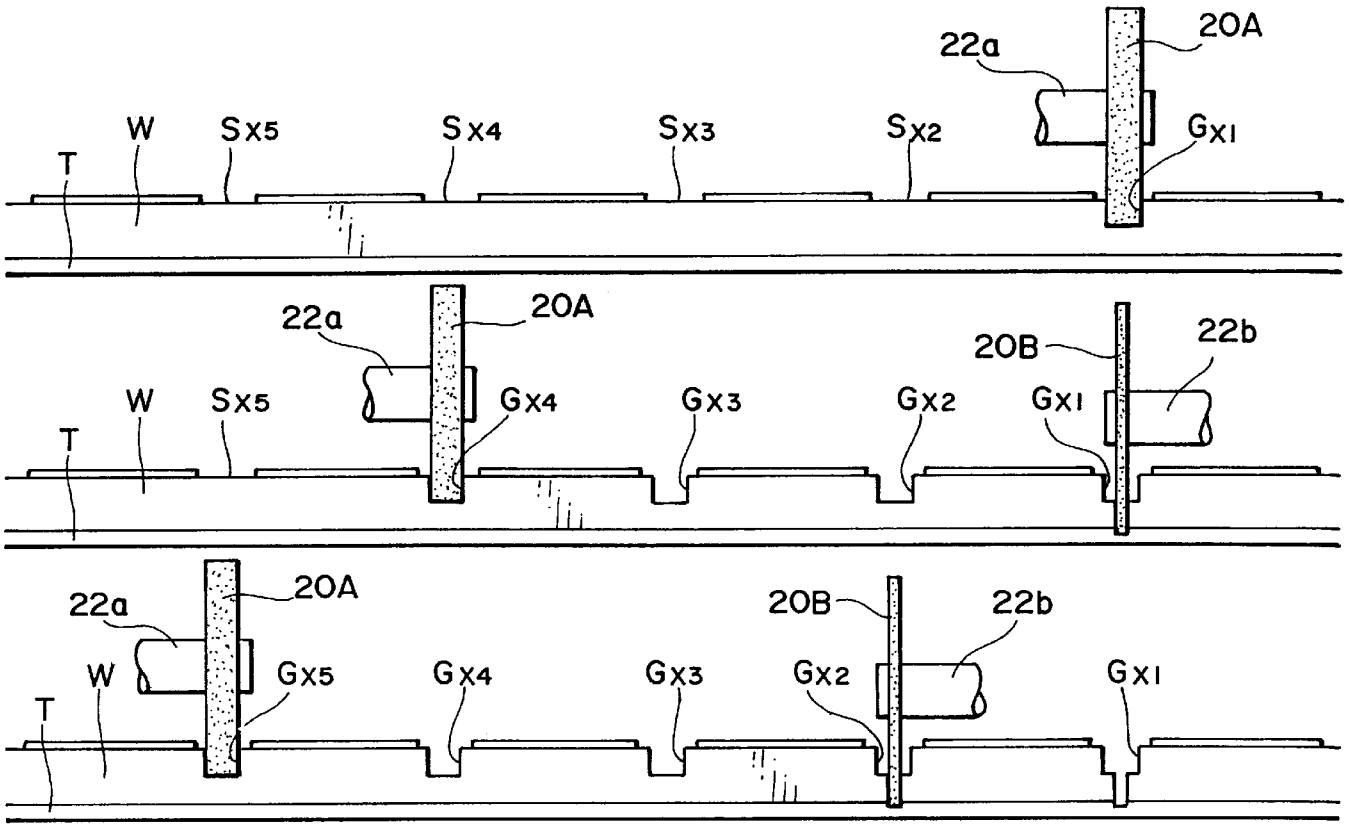
FIGS. 3(*a*), 3(*b*) and 3(*c*) are explanation drawings showing the step-cut method.

As shown in FIG. 3(*b*), when the first blade 20A reaches the fourth street $S_{X4}$, the second blade 20B is in the first groove $G_{X1}$. The controlling device drives the moving mechanism to move the wafer table 12 along the X-axis so that the first blade 20A cuts the wafer W along the fourth street $S_{X4}$ with the predetermined depth and the second blade 20B cuts the wafer W along the first groove $G_{X1}$ to cut off the wafer W along the first street $S_{X1}$.

After that, the controlling device drives the sliding devices of the spindle moving mechanism to move the first blade 20A and the second blade 20B one pitch along the Y-axis. Then, the controlling device moves the wafer table 12 along the X-axis so that the first blade 20A cuts the wafer W along the fifth street $S_{X5}$ and the second blade 20B cuts the wafer W along the second groove $G_{X2}$ as shown in FIG. 3(*c*). The above-described cutting operation is repeated again and again so that the first blade 20A and the second blade 20B sequentially cut off the wafer W along the streets $S_{X1}$, $S_{X2}$, . . . along the X-axis.

After the wafer W is cut off along all the streets $S_{X1}$, $S_{X2}$, . . . along the X-axis, the controlling device rotates the wafer table 12 by 90°, and then the first blade 20A and the second blade 20B sequentially cut off the wafer W along streets $S_{Y1}$, $S_{Y2}$, . . . along the Y-axis in the same way as the streets $S_{X1}$, $S_{X2}$, . . . . The wafer W is finally cut into the dice.

The kerf inspecting method applied to the above-described twin-spindle dicing saw 10 will now be explained.

The controlling device inspects the kerfs at the predetermined time or in accordance with the instruction of the operator.

The method in which the controlling device automatically inspects the kerfs at the predetermined time will be first explained.

Figure 4:
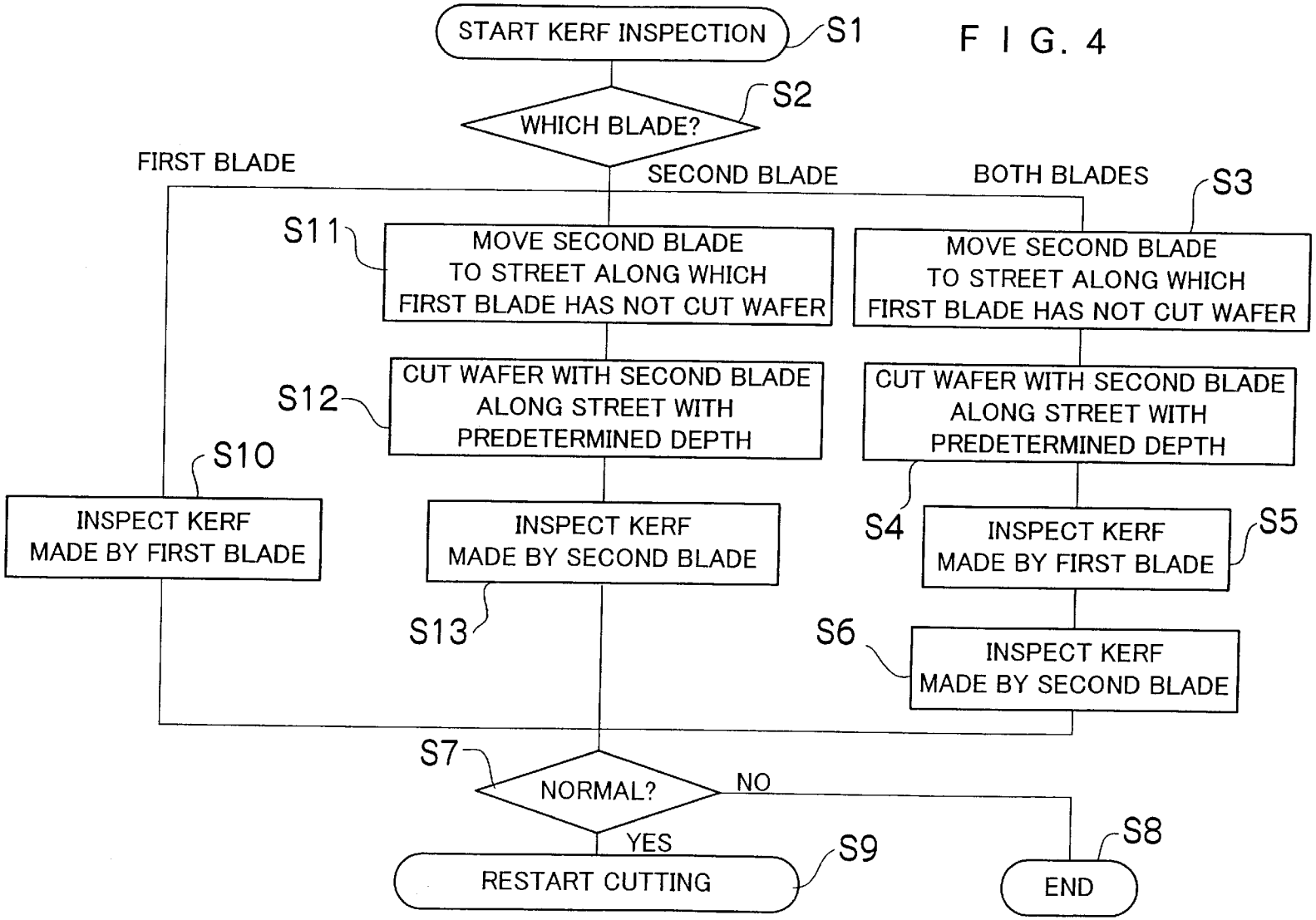
FIG. 4 is a flow chart showing a method in which kerfs are automatically inspected at a predetermined time.
Figure 5A:
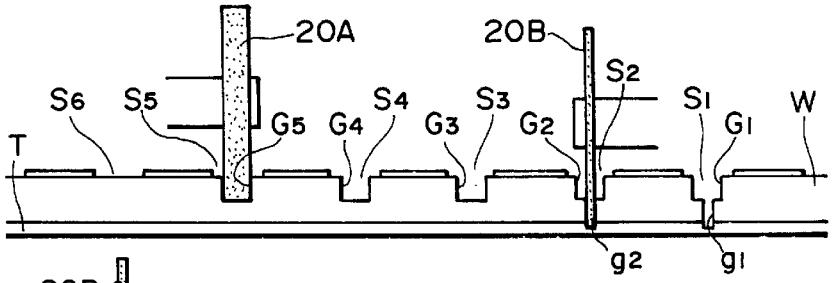
FIGS. 5(*a*), 5(*b*), 5(*c*), 5(*d*) and 5(*e*) are explanation drawings showing a kerf inspecting method.
Figure 5B:
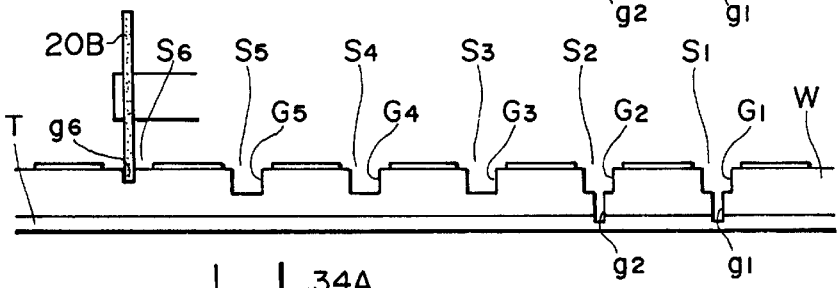
Figure 5C:
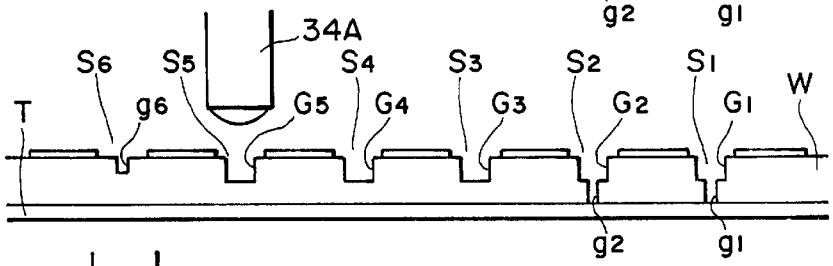
Figure 5D:
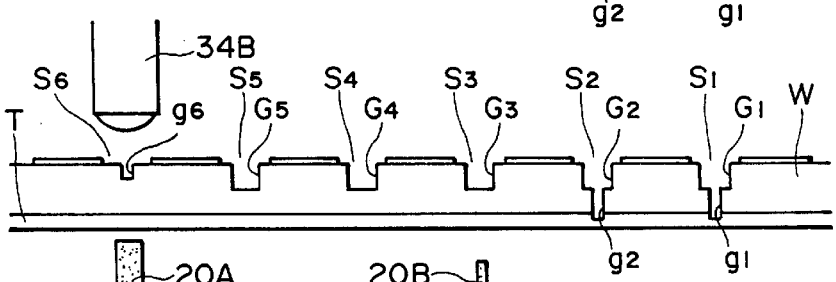
Figure 5E:
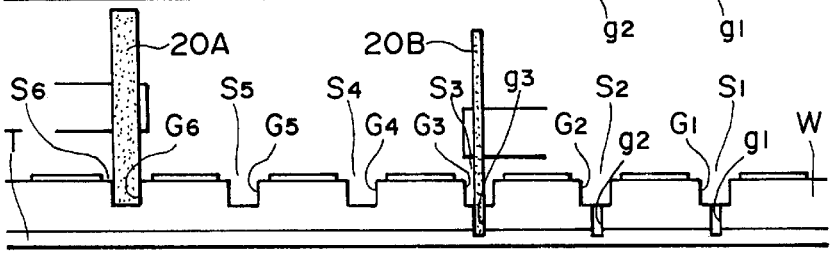

FIG. 4 is a flow chart showing the method in which the controlling device automatically inspects the kerfs at the predetermined time.

If a mode for automatically inspecting the kerfs is selected, the controlling device counts the number of streets along which the first blade 20A has cut the wafer W and the number of streets along which the second blade 20B has cut the wafer W When one of the numbers reaches a predetermined number, the controlling device automatically starts inspecting the kerfs (step 1).

First, the controlling device determines which blade has cut the wafer W along the predetermined number of streets (step 2). The case in which both blades 20A and 20B have cut the wafer W along the predetermined numbers of streets will now be explained.

As shown in FIG. 5(*a*), the first blade 20A cuts the wafer W along the fifth street $S_{X5}$ to make the groove $G_5$ with the predetermined depth and the second blade 20B cuts the wafer W along the second groove $G_2$ made by the first blade 20A. The controlling device suspends the cutting operation when both blades 20A and 20B have cut the wafer W along the predetermined numbers of streets.

Then, as shown in FIG. 5(*b*), the controlling device moves the second blade 20B to the street $S_6$ along which the first blade 20A has not cut the wafer W (step 3). Next, the second blade 20B cuts the wafer W along the street $S_6$ with a predetermined depth (step 4).

After that, the ITV camera 34A images the groove $G_5$ made by the first blade 20A as shown in FIG. 5(*c*). Then, the image processing device 38 processes the image data to inspect the kerf made by the first blade 20A (step 5). In the kerf inspection, the image processing device 38 determines the position and the width of the groove $G_5$ made by the first blade 20A and whether or not chipping has occurred in the groove $G_5$.

Next, the ITV camera 34B images the groove $g_6$ made by the second blade 20B as shown in FIG. 5(*d*). Then, the image processing device 38 processes the image data to inspect the kerf made by the second blade 20B (step 6). In the kerf inspection, the image processing device 38 determines the position and the width of the groove $g_6$ made by the second blade 20B and whether or not chipping has occurred in the groove $g_6$.

After the kerf inspections, the controlling device determines whether or not the kerfs are normal according to the results of the kerf inspection (step 7). If the kerfs are abnormal, the controlling device issues a warning and stops the operation of the dicing saw (step 8). If the kerfs are normal, the controlling device restarts cutting the wafer W (step 9). As shown in FIG. 5(*e*), the first blade 20A cuts the wafer W along the street $S_6$ with the predetermined depth and the second blade 20B cuts the wafer W along the groove $G_3$.

Since the groove $g_6$ has been made along the street $S_6$ by the second blade 20B in the kerf inspection, the first blade 20A cuts the wafer W along the groove $g_6$ to make the groove $G_6$ with the predetermined depth.

In the kerf inspecting method, the second blade 20B cuts the wafer W along the street $S_6$ before the first blade 20A, and thus the kerfs can be accurately inspected.

The depth of the groove $g_6$ made by the second blade 20B in the kerf inspection is smaller than that of the groove $G_6$ made by the first blade 20A along the same street $S_6$ after the kerf inspections.

The case in which only the first blade 20A has cut the wafer W along the predetermined number of streets will now be explained. In this case, only a kerf made by the first blade 20A is inspected.

Since the first blade 20A cuts the wafer W along the street $S_5$ before the second blade 20B as shown in FIG. 5(*a*), the first blade 20A never cuts the wafer W along a groove made by the second blade 20B. Thus, a kerf can be inspected soon after the kerf is made by the first blade 20A in the regular cutting.

The controlling device suspends the cutting operation when the first blade 20A has cut the wafer W along the predetermined number of streets. After that, the ITV camera 34A images the groove $G_5$ made by the first blade 20A as shown in FIG. 5(*c*). Then, the image processing device 38 processes the image data to inspect the kerf made by the first blade 20A (step 10).

After the kerf inspection, the controlling device determines whether or not the kerf is normal according to the results of the kerf inspection (step 7). If the kerf is abnormal, the controlling device issues a warning and stops the operation of the dicing saw (step 8). If the kerf is normal, the controlling device restarts cutting the wafer W (step 9). As shown in FIG. 5(*e*), the first blade 20A cuts the wafer W along the street $S_6$ with the predetermined depth and the second blade 20B cuts the wafer W along the groove $G_3$.

The case in which only the second blade 20B has cut the wafer W along the predetermined number of streets will now be explained. In this case, only a kerf made by the second blade 20B is inspected.

Since the second blade 20B cuts the wafer W along the street $S_2$ after the first blade 20A as shown in FIG. 5(*a*), the kerf can not be accurately inspected in this state.

When the second blade 20B has cut the wafer W along the predetermined number of streets, the controlling device moves the second blade 20B to the street $S_6$ along which the first blade 20A has not cut the wafer W (step 11). Next, the second blade 20B cuts the wafer W along the street $S_6$ with the predetermined depth as shown in FIG. 5(*b*) (step 12). After that, the ITV camera 34B images the groove $g_6$ made by the second blade 20B as shown in FIG. 5(*d*). Then, the image processing device 38 processes the image data to inspect the kerf made by the second blade 20B (step 13).

After the kerf inspection, the controlling device determines whether or not the kerf is normal according to the results of the kerf inspection (step 7). If the kerf is abnormal, the controlling device issues a warning and stops the operation of the dicing saw (step 8). If the kerf is normal, the controlling device restarts cutting the wafer W (step 9). As shown in FIG. 5(*e*), the first blade 20A cuts the wafer W along the street $S_6$ with the predetermined depth and the second blade 20B cuts the wafer W along the groove $G_3$.

Since the groove $g_6$ has been made along the street $S_6$ by the second blade 20B in the kerf inspection, the first blade 20A cuts the wafer W along the groove $g_6$ to make the groove $G_6$ with the predetermined depth.

In the kerf inspecting method, the second blade 20B cuts the wafer W along the street $S_6$ before the first blade 20A, and thus the kerf can be accurately inspected.

The method in which the controlling device inspects the kerfs in accordance with the instruction of the operator will be explained next.

Figure 6:
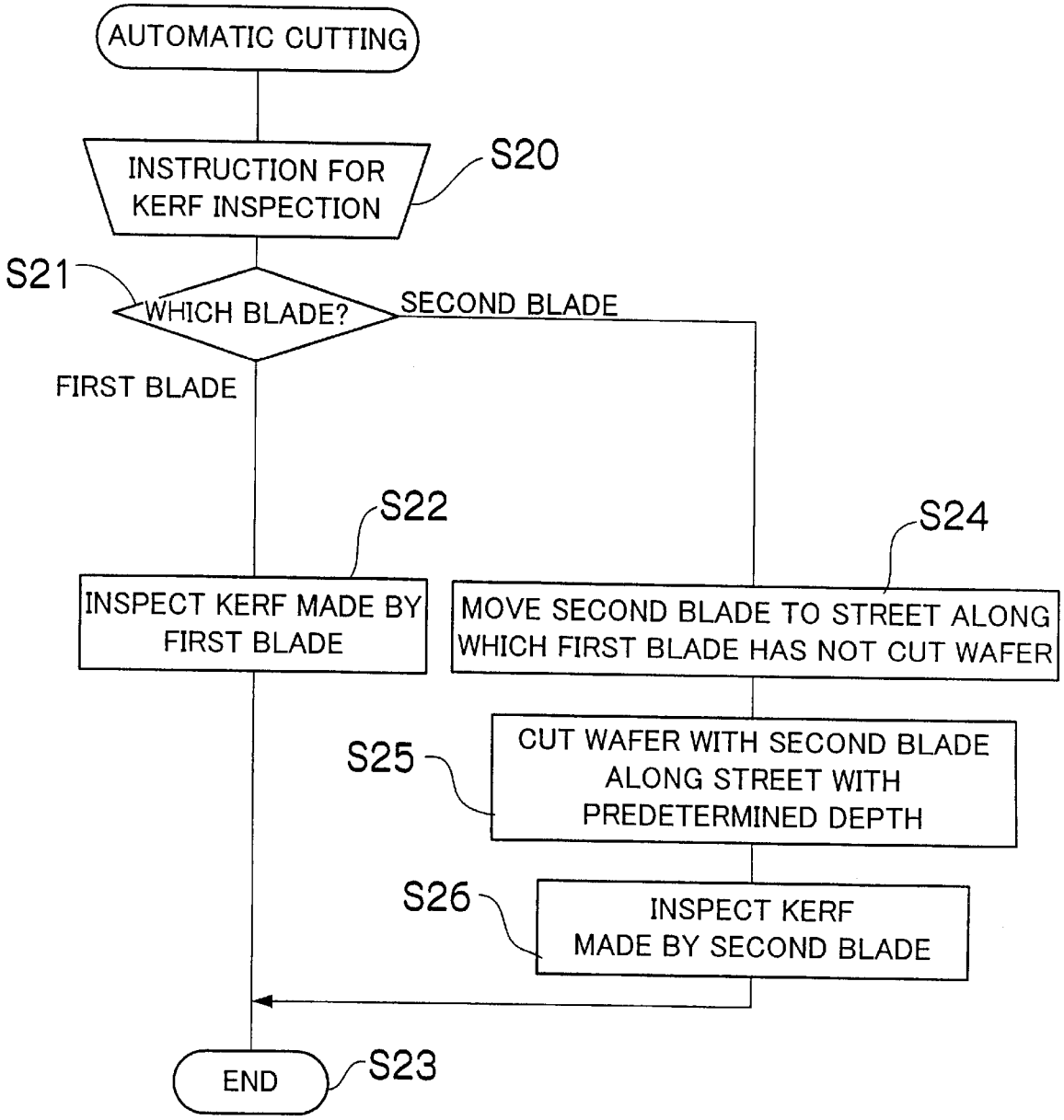
FIG. 6 is a flow chart showing a method in which kerfs are inspected in accordance with an instruction of an operator.

FIG. 6 is a flow chart showing the method in which the controlling device inspects the kerfs in accordance with the instruction of the operator.

If the operator inputs the instruction for the automatic kerf inspection with an outside inputting device (not shown) (step 20), the controlling device suspends the cutting operation after cutting the wafer W along the current street whether or not the mode for automatically inspecting the kerfs is selected.

The operator determines whether to inspect a kerf made by the first blade 20A or inspect a kerf made by the second blade 20B, and inputs which blade with the inputting device to the controlling device (step 21). The case in which the operator chooses the first blade 20A will be first explained.

Since the first blade 20A cuts the wafer W along the street $S_5$ before the second blade 20B as shown in FIG. 5(*a*), the first blade 20A never cuts the wafer W along a groove made by the second blade 20B. For this reason, the controlling device inspects the latest kerf in this case.

Then, the ITV camera 34A images the groove $G_5$ made by the first blade 20A. Next, the image processing device 38 processes the image data in order to inspect the kerf made by the first blade 20A (step 22). After the kerf inspection (step 23), the controlling device or the operator determines whether or not the kerf is normal according to the results of the kerf inspection. If the kerf is abnormal, the controlling device issues a warning and stops the operation of the dicing saw. If the kerf is normal, the controlling device restarts the cutting of the wafer W As shown in FIG. 5(*e*), the first blade 20A cuts the wafer W along the street $S_6$ with the predetermined depth and the second blade 20B cuts the wafer W along the groove $G_3$.

The case in which the operator chooses the second blade 20B will be explained next.

Since the second blade 20B cuts the wafer W along the street $S_2$ after the first blade 20A as shown in FIG. 5(*a*), the kerf can not be accurately inspected in this state.

Then, the controlling device moves the second blade 20B to the street $S_6$ along which the first blade 20A has not cut the wafer W (step 24). Next, the second blade 20B cuts the wafer W along the street $S_6$ with the predetermined depth as shown in FIG. 5(*b*) (step 25).

After that, the ITV camera 34B images the groove $g_6$ made by the second blade 20B as shown in FIG. 5(*d*). Then, the image processing device 38 processes the image data to inspect the kerf made by the second blade 20B (step 26).

After the kerf inspection (step 23), the controlling device or the operator determines whether or not the kerf is normal according to the results of the kerf inspection. If the kerf is abnormal, the controlling device issues a warning and stops the operation of the dicing saw. If the kerf is normal, the controlling device restarts the cutting of the wafer W. As shown in FIG. 5(*e*), the first blade 20A cuts the wafer W along the street $S_6$ with the predetermined depth and the second blade 20B cuts the wafer W along the groove $G_3$.

In the kerf inspecting method, the second blade 20B cuts the wafer W along the street $S_6$ before the first blade 20A, and thus the kerf can be accurately inspected.

The case in which the operator inspects the kerfs manually by sight instead of the image processing device 38 will now be explained.

Figure 7:
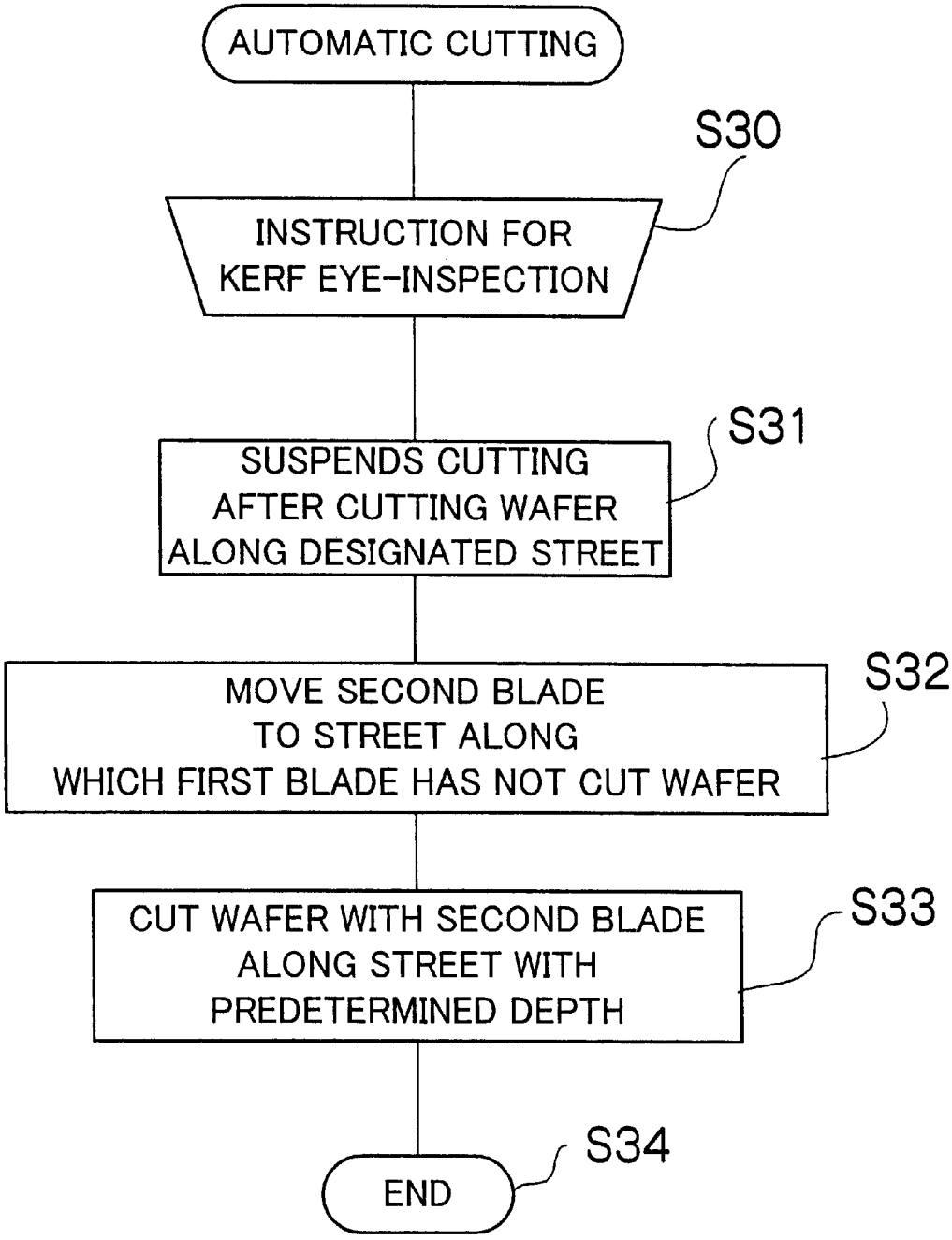
FIG. 7 is a flow chart showing a case in which the operator inspects the kerf manually by sight.
Figure 8:
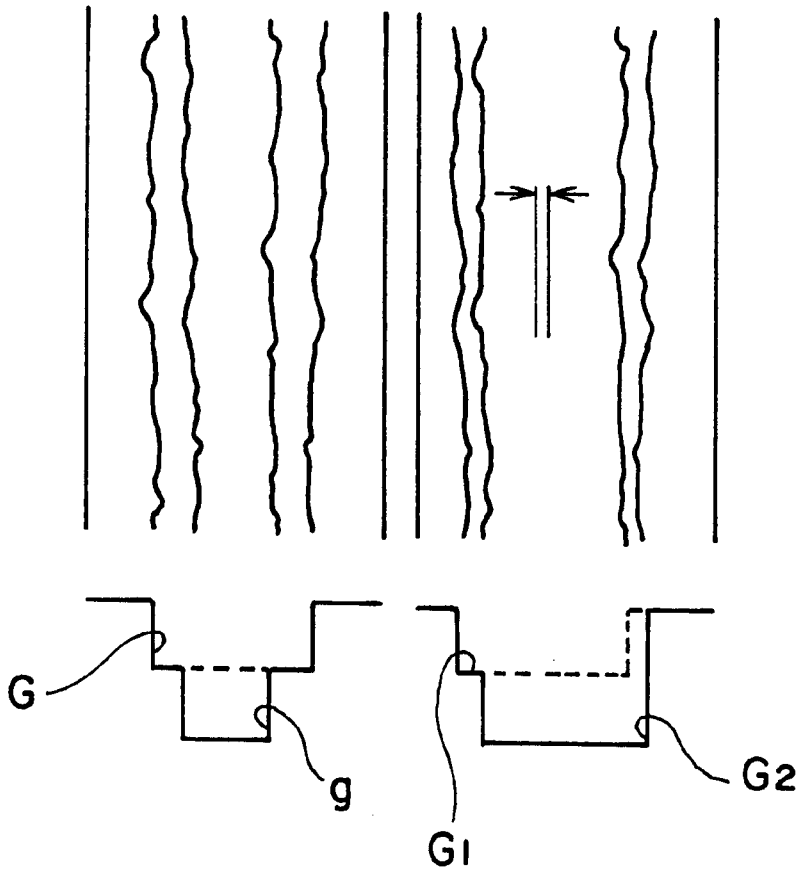
FIGS. 8(*a*) and 8(*b*) are explanation drawings showing conventional kerf inspecting methods.

FIG. 7 is a flow chart showing the case in which the operator inspects the kerf manually by sight.

If the operator inputs the instruction for the kerf eye-inspection with the outside inputting device (not shown) (step 30), the controlling device suspends the cutting operation after cutting the wafer W along an operator-designated street whether or not the mode for automatically inspecting the kerfs is selected (step 31).

Then, the controlling device moves the second blade 20B to the street $S_6$ along which the first blade 20A has not cut the wafer W (step 32). Next, the second blade 20B cuts the wafer W along the street $S_6$ with the predetermined depth as shown in FIG. 5(*b*) (step 33). After that, the controlling device stops the operation of the twin-spindle dicing saw 10 (step 34).

The operator inspects the kerfs manually by sight with a monitor or a microscope. In the inspections, the operator determines the positions and the widths of the grooves made by the first blade 20A and the second blade 20B and whether or not chipping has occurred in the grooves. After the kerf inspections, the operator determines whether or not the kerfs are normal according to the results of the kerf inspections. If the kerfs are abnormal, the operator stops the operation of the dicing saw. If the kerfs are normal, the operator restarts the cutting operation. As shown in FIG. 5(*e*), the first blade 20A cuts the wafer W along the street $S_6$ with the predetermined depth and the second blade 20B cuts the wafer W along the groove $G_3$.

In the kerf inspecting method, the second blade 20B cuts the wafer W along the street $S_6$ before the first blade 20A, and thus the kerfs can be accurately inspected.

The first blade 20A is thicker than the second blade 20B in the embodiment, but they may be of the same thickness. In this case, if the kerfs were made along the same street in the conventional kerf inspecting method, the positions and the widths of the kerfs could not be accurately determined. However, in the kerf inspecting method of the present invention, the kerfs are made along different streets, and thus the positions and the widths of the kerfs can be accurately determined.

In the embodiment, the operation of the dicing saw is stopped when a kerf is abnormal. However, if a kerf position is abnormal, the kerf position may be automatically corrected before the operation of the dicing saw is restarted. In this case, a gap δ between the center of the street and the center of the groove is calculated from the result of the kerf inspection (the centers are the same if the groove is precisely made), and the blade position is corrected so that the gap δ becomes 0. After the correction, the cutting operation is restarted. Therefore, the dicing saw can always cut the wafer W precisely without being stopped.

The dicing saw has the pair of imaging units 16A and 16B in the embodiment, but they may be integrated as one unit.

As set forth hereinabove, according to the kerf inspecting method of the present invention, the first blade and the second blade cut the wafer along the different streets. Thus, the kerfs can be accurately inspected.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A kerf inspecting method for a dicing apparatus that comprises a first blade for cutting a wafer having a plurality of streets along selected streets on the wafer to make a groove with a first predetermined depth and a second blade for cutting the wafer along the groove to cut off the wafer along the street, the kerf inspecting method comprising the steps of:

cutting a wafer along a selected street on the wafer to make a groove with a first predetermined depth with the first blade;

cutting-off part of the wafer along the groove formed in the selected street by the first blade using the second blade;

cutting the wafer along an uncut street with the second blade to make an inspection kerf with a second predetermined depth; and inspecting the inspection kerf made by the second blade.

2. The kerf inspecting method as defined in claim 1, wherein:

the second predetermined depth of the kerf made by the second blade is smaller than the first predetermined depth of the groove made by the first blade; and after the kerf is inspected, the first blade cuts the wafer along the kerf made by the second blade to make the groove with the first predetermined depth, and the second blade then cuts the wafer along the groove to cut off the wafer along the street.

3. A kerf inspecting method for a dicing apparatus that comprises a first blade for cutting a wafer having a plurality of streets along selected streets on the wafer to make a groove with a first predetermined depth and a second blade for cutting the wafer along the groove to cut off the wafer along the street, the kerf inspecting method comprising the steps of:

cutting the wafer along uncut first street with the first blade to make a first inspection kerf with a second predetermined depth;

cutting the wafer along uncut second street with the second blade to make a second inspection kerf with a third predetermined depth; and inspecting the first and second inspection kerfs made by the first blade and the second blade.

4. The kerf inspecting method as defined in claim 3, wherein:

the third predetermined depth of the second kerf made by the second blade is smaller than the first predetermined depth of the groove made by the first blade; and after the second kerf is inspected, the first blade cuts the wafer along the second kerf made by the second blade to make the groove with the first predetermined depth, and the second blade then cuts the wafer along the groove to cut off the wafer along the second street.

5. The kerf inspecting method as defined in claim 3, wherein the second predetermined depth of the first kerf made by the first blade is equal to the first predetermined depth of the groove made by the first blade.

6. A kerf inspecting system for a dicing apparatus that comprises a first blade, a second blade and a controlling device, the controlling device being adapted to control the first blade and the second blade so that the first blade cuts a wafer having a plurality of streets along a selected street on the wafer to make a groove with a first predetermined depth and the second blade cuts the wafer along the groove to cut off the wafer along the street, wherein, when the second blade has cut the wafer along a predetermined number of streets, the controlling device is adapted to make the second blade cut the wafer along uncut street to make an inspection kerf with a second predetermined depth;

wherein the dicing apparatus further comprises an imaging device and an image processing device;

wherein the controlling device makes the imaging device capture an image of the kerf made by the second blade; and wherein the controlling device makes the image processing device inspect the kerf by processing the image captured by the imaging device.

7. A kerf inspecting system for a dicing apparatus that comprises a first blade, a second blade and a controlling device, the controlling device being adapted to control the first blade and the second blade so that the first blade cuts a wafer having a plurality of streets along a selected street on the wafer to make a groove with a first predetermined depth and the second blade cuts the wafer along the groove to cut off the wafer along the street, wherein, when the second blade has cut the wafer along a predetermined number of streets, the controlling device is adapted to make the second blade cut the wafer along uncut street to make an inspection kerf with a second predetermined depth;

wherein the second predetermined depth of the kerf made by the second blade is smaller than the first predetermined depth of the groove made by the first blade; and wherein, after the kerf is inspected, the first blade cuts the wafer along the kerf made by the second blade to make the groove with the first predetermined depth, and the second blade then cuts the wafer along the groove to cut off the wafer along the street.

8. A kerf inspecting system for a dicing apparatus that comprises a first blade, a second blade and a controlling device, the controlling device being adapted to control the first blade and the second blade so that the first blade cuts a wafer having a plurality of streets along a selected street on the wafer to make a groove with a first predetermined depth and the second blade cuts the wafer along the groove to cut off the wafer along the street, wherein the controlling device is adapted to respond to an instruction signal for a kerf inspection of the second blade input from an outside inputting device in a manner causing the second blade to cut the wafer along an uncut street to make an inspection kerf with a second predetermined depth, wherein the dicing apparatus further comprises an imaging device and an image processing device;

wherein the controlling device makes the imaging device capture an image of the kerf made by the second blade; and wherein the controlling device makes the image processing device inspect the kerf by processing the image captured by the imaging device.

9. A kerf inspecting system for a dicing apparatus that comprises a first blade, a second blade and a controlling device, the controlling device being adapted to control the first blade and the second blade so that the first blade cuts a wafer having a plurality of streets along a selected street on the wafer to make a groove with a first predetermined depth and the second blade cuts the wafer along the groove to cut off the wafer along the street, wherein the controlling device is adapted to respond to an instruction signal for a kerf inspection of the second blade input from an outside inputting device in a manner causing the second blade to cut the wafer along an uncut street to make an inspection kerf with a second predetermined depth;

wherein the second predetermined depth of the kerf made by the second blade is smaller than the first predetermined depth of the groove made by the first blade; and wherein, after the kerf is inspected, the first blade cuts the wafer along the kerf made by the second blade to make the groove with the first predetermined depth, and the second blade then cuts the wafer along the groove to cut off the wafer along the street.

* * * * *